US008192165B2

(12) United States Patent
Higashida

(10) Patent No.: US 8,192,165 B2
(45) Date of Patent: Jun. 5, 2012

(54) IMPELLER OF MULTIBLADE FAN AND MULTIBLADE FAN HAVING THE SAME

(75) Inventor: Masahito Higashida, Sakai (JP)

(73) Assignee: Daikin Industries, Ltd., Osaka (JP)

( * ) Notice: Subject to any disclaimer, the term of this patent is extended or adjusted under 35 U.S.C. 154(b) by 819 days.

(21) Appl. No.: 11/659,212

(22) PCT Filed: Sep. 5, 2005

(86) PCT No.: PCT/JP2005/016260

§ 371 (c)(1),
(2), (4) Date: Feb. 2, 2007

(87) PCT Pub. No.: WO2006/028057

PCT Pub. Date: Mar. 16, 2006

(65) Prior Publication Data

US 2007/0201976 A1 Aug. 30, 2007

(30) Foreign Application Priority Data

Sep. 6, 2004 (JP) ..... 2004-258816

(51) Int. Cl.
*F01D 5/22* (2006.01)

(52) U.S. Cl. ..... 416/187; 416/189

(58) Field of Classification Search ..... 415/56.3, 415/159, 185, 190, 204, 208.2; 416/187.189, 416/210 R, 228, 243; 361/695
See application file for complete search history.

(56) References Cited

U.S. PATENT DOCUMENTS 5,601,400 A * 2/1997 Kondo et al. ..... 415/119
5,813,831 A * 9/1998 Matsunaga et al. ..... 415/173.6
6,092,988 A * 7/2000 Botros ..... 415/191
6,299,409 B1 * 10/2001 Matsunaga et al. ..... 415/206
6,468,038 B1 10/2002 Kikuchi et al.
6,595,265 B2 7/2003 Kikuchi et al.
6,604,906 B2 * 8/2003 Ozeki et al. ..... 415/204

(Continued)

FOREIGN PATENT DOCUMENTS

DE 1905269 A1 8/1970

(Continued)

OTHER PUBLICATIONS

European Search Report of corresponding EP Application No. 05 77 7048.9 dated Jan. 18, 2012.

*Primary Examiner* — Edward Look
*Assistant Examiner* — Sean J Younger
(74) *Attorney, Agent, or Firm* — Global IP Counselors

(57) ABSTRACT

An impeller of a multiblade fan includes a discoid main plate that rotates about a rotational axis, blades, and a side plate. The blades are disposed annularly about the rotational axis on one side of the main plate, with one end of each of the blades being fixed to an outer peripheral portion of the main plate. The side plate includes an annular side plate body portion that joins outer peripheral edges of the other ends of the blades to each other, an axially extending portion that extends from an opposite-main plate side end of the side plate body portion in the rotational axis direction further than the opposite-main plate side ends of the blades, and a radially extending portion that extends from an outer peripheral end of the side plate body portion further than a radial-direction outer peripheral end of the axially extending portion.

19 Claims, 12 Drawing Sheets

U.S. PATENT DOCUMENTS

| | | | | |
|---|---|---|---|---|
| 6,821,088 | B2 * | 11/2004 | Sakai et al. | 415/204 |
| 6,890,159 | B2 * | 5/2005 | Motomura | 417/423.12 |
| 6,893,220 | B2 * | 5/2005 | Eaton et al. | 415/206 |
| 2004/0131465 | A1 | 7/2004 | Ochiai et al. | |

FOREIGN PATENT DOCUMENTS

| | | | |
|---|---|---|---|
| FR | 2 163 273 | A | 7/1973 |
| JP | 50-49711 | A | 5/1975 |
| JP | 60-173700 | | 11/1985 |
| JP | 03-039828-A | U | 2/1991 |
| JP | 09-209994 | A | 8/1997 |
| JP | 10-54388 | A | 2/1998 |
| JP | 10-311294 | A | 11/1998 |
| JP | 2004-190535 | A | 7/2004 |
| KR | 2000-0062679 | A | 10/2000 |

* cited by examiner

IMPELLER OF MULTIBLADE FAN AND MULTIBLADE FAN HAVING THE SAME

CROSS-REFERENCE TO RELATED APPLICATIONS

This U.S. National stage application claims priority under 35 U.S.C. §119(a) to Japanese Patent Application No. 2004-258816, filed in Japan on Sep. 6, 2004, the entire contents of which are hereby incorporated herein by reference.

TECHNICAL FIELD

The present invention relates to an impeller of a multiblade fan and to a multiblade fan having the same, and in particular to an impeller of a multiblade fan where end portions of plural blades extending from a main plate are connected to each other by an annular side plate and to a multiblade fan having the same.

BACKGROUND ART

In air purifiers and air conditioners and the like, a multiblade fan is used in order to perform blowing. As a conventional example, FIG. 1 and FIG. 2 show an example of a single suction type multiblade fan. Here, FIG. 1 shows a side view (specifically, an A-A cross-sectional view of FIG. 2) of the conventional single suction type multiblade fan, and FIG. 2 shows a plan view of the conventional single suction type multiblade fan.

A multiblade fan 10 is configured by an impeller 13, a casing 11 that houses the impeller 13, a motor 14 for driving the impeller 13 to rotate and the like. Here, axis O-O in FIG. 1 and FIG. 2 is the axial line of rotation of the impeller 13 and the motor 14.

In the impeller 13, one end of each of numerous blades 33 (in FIG. 2, just some of the numerous blades 33 are shown) is fixed to an outer peripheral portion of one side of a discoid main plate 31, and outer peripheral edges of the other ends of the blades 33 are connected to each other by an annular side plate 32.

The casing 11 includes a suction opening 11*a* that sucks in gas from one side in the rotational axis O direction and a blowout opening 11*b* that blows out gas in a direction intersecting the rotational axis O. The periphery of the suction opening 11*a* is surrounded by a bellmouth 12 that leads to the impeller 13. Additionally, the suction opening 11*a* is disposed so as to face the side plate 32. Further, the blowout opening 11*b* is disposed so as to blow gas in the direction intersecting the rotational axis O.

When the motor 14 is driven to cause the multiblade fan 10 to run, the impeller 13 rotates in the rotational direction R of FIG. 2 with respect to the casing 11. Thus, the blades 33 of the impeller 13 boost the pressure of and blow out gas from the space on the inner peripheral side to the space on the outer peripheral side, the gas is sucked from the suction opening 11*a* into the space on the inner peripheral side of the impeller 13, and the gas blown out to the outer peripheral side of the impeller 13 is gathered in the blowout opening 11*b* and blown out (e.g., see JP-A No. 9-209994).

SUMMARY OF THE INVENTION

In the above-described conventional multiblade fan 10, the majority of the gas sucked into the space on the inner peripheral side of the impeller 13 is mainly a flow that sucks in gas through the suction opening 11*a* from the rotational axis O direction (this will be called "suction main flow W" below; see arrows W shown in FIG. 1), but as indicated by arrows X shown in FIG. 1, some gas is also included in a flow where, inside the casing 11, some of the gas blown out to the outer peripheral side of the impeller 13 is again sucked into the space on the inner peripheral side of the impeller 13 from between the side plate 32 and the portion of the inner surface of the casing 11 surrounding the suction opening 11*a* (this will be called "swirling flow X" below). This swirling flow X flows into the space on the inner peripheral side of the impeller 13 and merges with the suction main flow W sucked in from the suction opening 11*a* of the casing 11, but when the vector of the suction main flow W and the vector of the flow of the swirling flow X do not coincide, turbulence in the flow of gas occurs, which becomes one cause of an increase of noise and a deterioration of blowing performance.

Further, as indicated by arrows Y shown in FIG. 1, inside the casing 11, it is easy for a flow that reversely flows from the outer peripheral side to the inner peripheral side of the impeller 13 to occur in the vicinity of the side plate 32 (this will be called "reverse-direction flow Y" below). The occurrence of this reverse-direction flow Y also becomes one cause of an increase of noise and a deterioration of blowing performance.

It is an object of the present invention to provide an impeller of a multiblade fan capable of reducing noise and improving blowing performance and a multiblade fan having the same.

An impeller of a multiblade fan pertaining to a first aspect of the present invention comprises a discoid main plate that rotates about a rotational axis, plural blades, and one or two side plates. The plural blades are disposed annularly about the rotational axis on one side or both sides of the main plate, with one end of each of the blades being fixed to an outer peripheral portion of the main plate. The side plate includes an annular side plate body portion that joins outer peripheral edges of the other ends of the plural blades to each other, an axially extending portion that extends from the opposite-main plate side end of the side plate body portion further toward the opposite-main plate side in the rotational axis direction than the opposite-main plate side ends of the blades, and a radially extending portion that extends from the outer peripheral end of the side plate body portion further toward the outer peripheral side than the radial-direction outer peripheral end of the axially extending portion.

In this impeller of a multiblade fan, the axially extending portion is disposed on the side plate, so the vector of the flow of the swirling flow coincides with the vector of the flow of the suction main flow, and turbulence of the flow of gas when the swirling flow merges with the suction main flow can be reduced. Further, the radially extending portion is disposed on the side plate, so the occurrence of reverse-direction flow can be controlled and the swirling flow can be promoted. In this manner, in this impeller of a multiblade fan, the axially extending portions and the radially extending portions are disposed on the side plate, so it becomes possible to control the reverse-direction flow and promote the swirling flow coinciding with the vector of the flow of the suction main flow, and it becomes possible to reduce noise and improve blowing performance.

Here, an impeller where the plural blades are disposed on one side of the main plate and which includes one side plate that joins the outer peripheral edges of the other ends of the blades to each other is an impeller of a single suction type multiblade fan. Further, an impeller where the plural blades are disposed on both sides of the main plate and which includes a side plate that joins the outer peripheral edges of the other ends of the blades disposed on one side of the main plate to each other and a side plate that joins the outer peripheral edges of the other ends of the blades disposed on the other side of the main plate to each other—that is, two side plates—is an impeller of a so-called double suction type multiblade fan.

An impeller of a multiblade fan pertaining to a second aspect of the present invention comprises the impeller of a multiblade fan pertaining to the first aspect of the present invention, wherein the side plate is formed so as to not overlap the plural blades when seen from the opposite-main plate side.

In this impeller of a multiblade fan, the plural blades and the side plate are disposed so as to not overlap when seen from the opposite-main plate side, so when the impeller is integrally molded using dies, integral molding can be performed without die removal of the portion of the side plate and die removal of the portion of the plural blades interfering.

A multiblade fan pertaining to a third aspect of the present invention comprises: the impeller of a multiblade fan pertaining to the first or second aspect of the present invention; a drive mechanism that drives the main plate to rotate; and a casing that includes one or two suction openings formed facing the side plate such that the suction opening can suck in gas from the rotational axis direction and a blowout opening that blows out gas in a direction intersecting the rotational axis.

Here, a casing disposed with one suction opening is used when using an impeller of a single suction type multiblade fan. Further, a casing disposed with two suction openings is used when using an impeller of a double suction type multiblade fan.

A multiblade fan pertaining to a fourth aspect of the present invention comprises the multiblade fan pertaining to the third aspect of the present invention, wherein an inner surface of the casing around the suction opening includes an annular convex portion that protrudes toward the opposite-impeller side. The opposite-main plate side end of the axially extending portion is disposed in correspondence to the convex portion.

In this multiblade fan, it becomes possible to allow the swirling flow to flow smoothly in the space between the inner surface of the casing around the suction opening and the axially extending portion, so the swirling flow can be promoted.

DETAILED DESCRIPTION OF THE INVENTION

Embodiments of an impeller of a multiblade fan pertaining to the present invention and a multiblade fan having the same will be described below on the basis of the drawings.

First Embodiment (1) Configuration of Multiblade Fan

Figure 3:
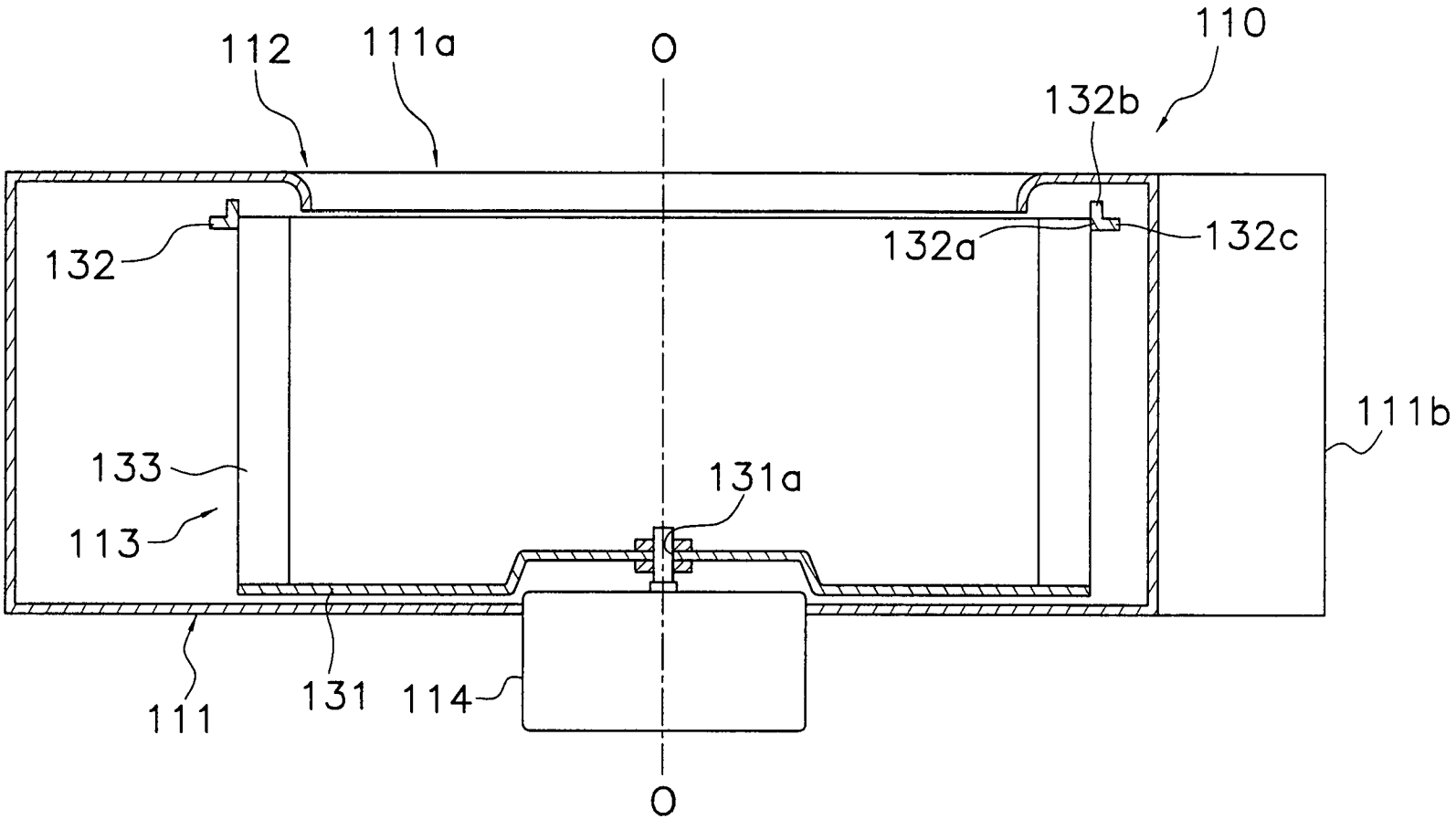
FIG. 3 is a side view of a multiblade fan pertaining to a first embodiment of the present invention.
Figure 4:
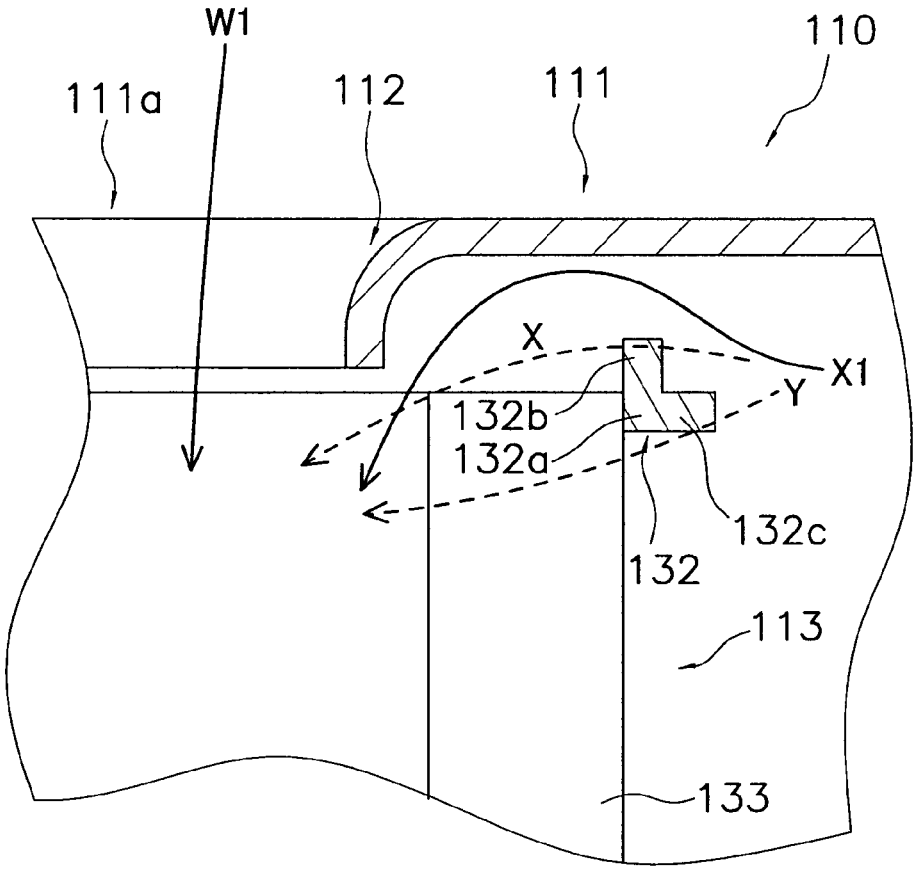
FIG. 4 is an enlarged view of FIG. 3 and a view showing the vicinity of a side plate of an impeller of the multiblade fan.

FIG. 3 and FIG. 4 show a multiblade fan 110 pertaining to a first embodiment of the present invention. Here, FIG. 3 shows a side view of the multiblade fan 110 pertaining to the first embodiment of the present invention. FIG. 4 is an enlarged view of FIG. 3 and is a view showing the vicinity of a side plate 132 of an impeller 113 of the multiblade fan 110.

Figure 1:
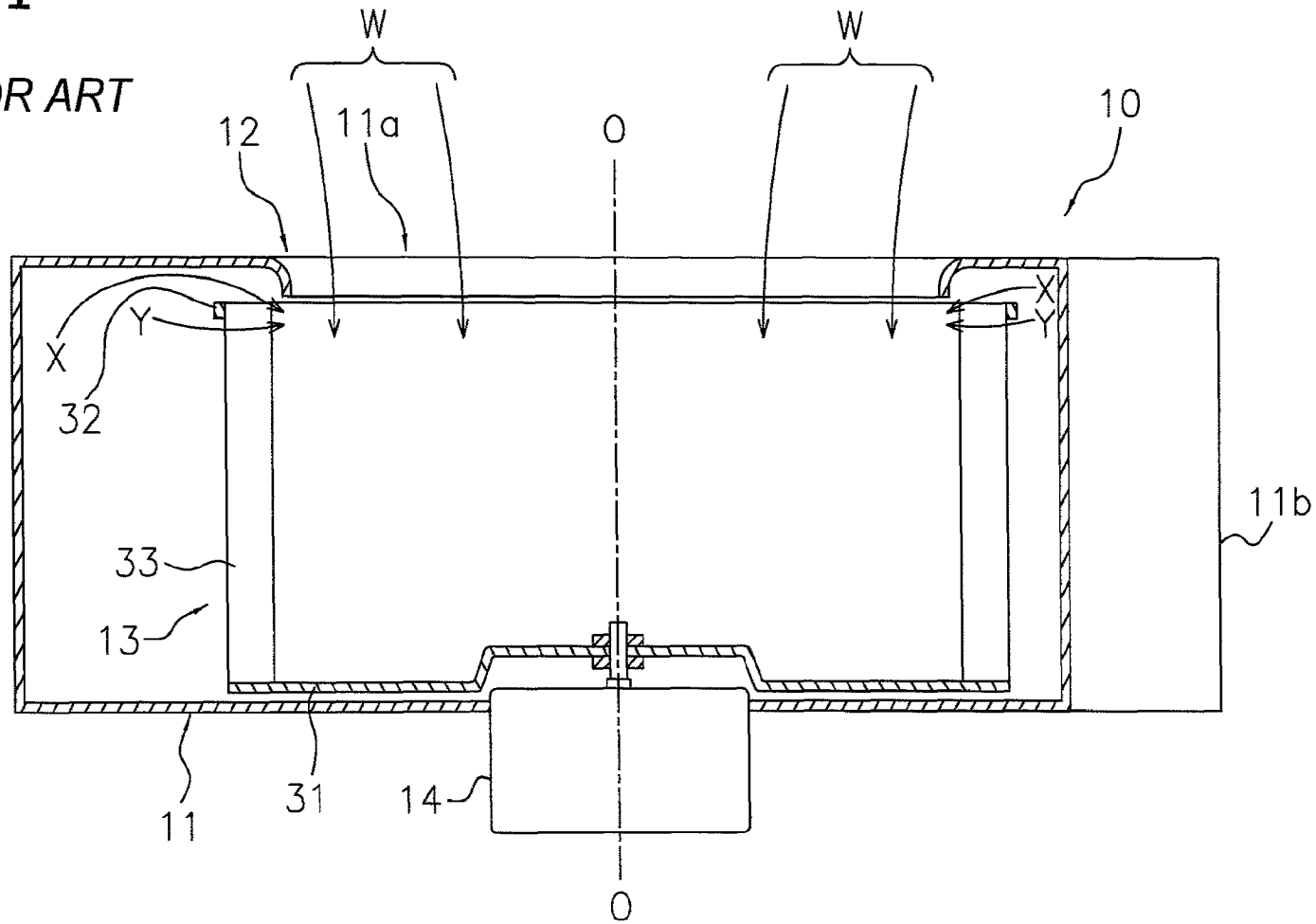
Fig. 1 PRIOR ART
FIG. 1 is a side view (A-A cross-sectional view of FIG. 2) of a conventional multiblade fan.
Figure 2:
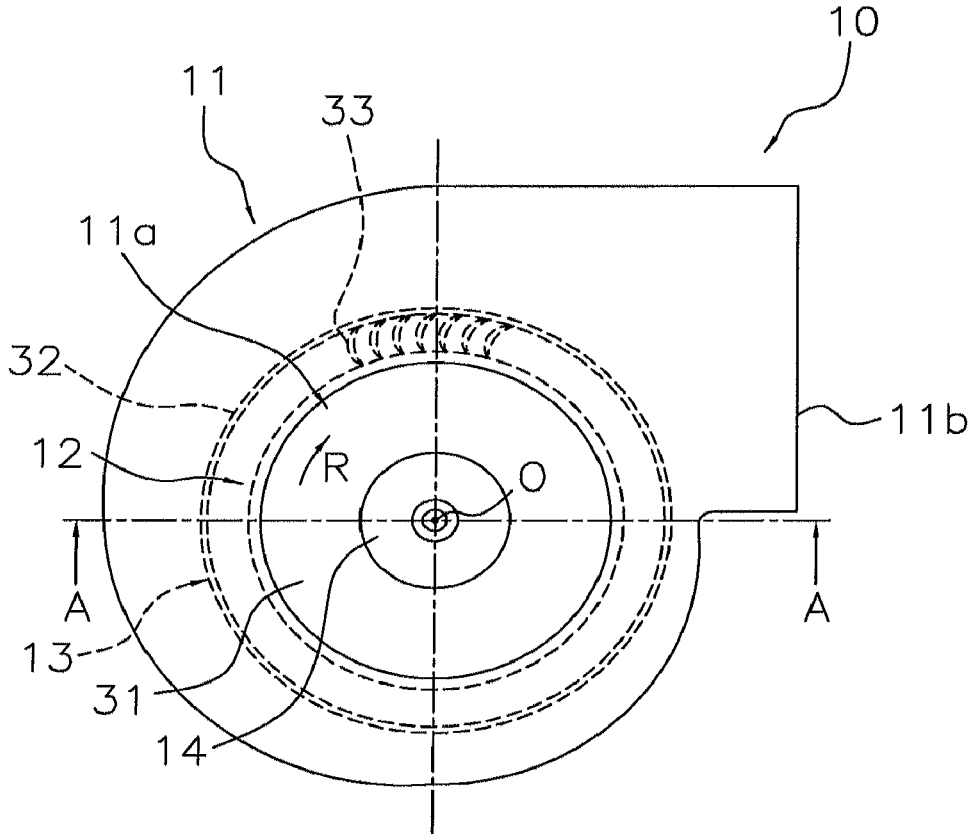
Fig. 2 PRIOR ART
FIG. 2 is a plan view of the conventional multiblade fan.

Similar to the conventional multiblade fan 10 (see FIG. 1 and FIG. 2), the multiblade fan 110 is a single suction type multiblade fan and is configured by an impeller 113, a casing 111 that houses the impeller 113, and a motor 114 for driving the impeller 113 to rotate and the like. Here, O-O in FIG. 3 is the axial line of rotation of the impeller 113 and the motor 114.

Similar to the conventional multiblade fan 10, the casing 111 is a casing with a scroll shape when seen in plan view (see FIG. 2) and includes a suction opening 111*a* that sucks in gas from one side in the rotational axis O direction and a blowout opening 111*b* that blows out gas in a direction intersecting the rotational axis O. The suction opening 111*a* is disposed so as to face a side plate 132 (described later) of the impeller 113. The periphery of the suction opening 111*a* is surrounded by a bellmouth 112 that leads to the impeller 113. The bellmouth 112 is a portion that is curved in a bell shape toward the impeller 113 side at the inner peripheral edge portion of the suction opening 111*a*.

Similar to the impeller 13 of the conventional multiblade fan 10, in the impeller 113, one end of each of numerous blades 133 is fixed to an outer peripheral portion of one side of a discoid main plate 131, and outer peripheral edges of the other ends of the blades 133 are connected to each other by an annular side plate 132. Further, as described later, the impeller 113 is a resin product that is integrally molded using dies.

The main plate 131 is a discoid portion and, as shown in FIG. 3, a center hole 131*a* is formed therein. A shaft of the motor 114 is coupled to the center hole 131*a*.

The blades 133 are disposed annularly about the rotational axis O, one end of each of the blades 133 is fixed to the outer peripheral portion of the main plate 131, and the blades 133 extend from there without skew along the rotational axis O. Additionally, the outer peripheral edges of the other ends of the blades 133 are connected to each other by the annular side plate 132. Additionally, each of the blades 133 has a shape where the blade chord length at the other end connected to the side plate 132 is slightly smaller with respect the blade chord length at the one end connected to the main plate 131.

The side plate 132 is disposed on the outer peripheral side of the other ends of the blades 133 and includes an annular side plate body portion 132*a*, an axially extending portion 132*b*, and a radially extending portion 132*c*.

Similar to the side plate 32 of the conventional impeller 13, the side plate body portion 132*a* is an annular portion that connects the outer peripheral edges of the other ends of the blades 133 to each other and is formed so as to not overlap the other ends of the blades 133 when the impeller 113 is seen from the opposite-main plate side (i.e., from the suction opening 111*a* side).

The axially extending portion 132*b* is an annular portion that extends from the opposite-main plate side end of the side plate body portion 132*a* further toward the opposite-main plate side in the rotational axis O direction than the opposite-main plate side ends of the blades 133. Additionally, the axially extending portion 132*b* has a shape where the opposite-main plate side end surface of the axially extending portion 132*b* is included in the end surface connected to the side plate body portion 132*a* when the impeller 113 is seen from the opposite-main plate side. Further, similar to the side plate body portion 132*a*, the radial-direction inner peripheral edge of the axially extending portion 132*b* is formed so as to not overlap the other ends of the blades 133 when the impeller 113 is seen from the opposite-main plate side. Moreover, in the present embodiment, the opposite-main plate side end of the axially extending portion 132*b* extends as far as a position overlapping the impeller-side end of the bellmouth 112 in the rotational axis O direction. Additionally, a gap for actively allowing a later-described swirling flow X1 to flow is disposed between the opposite-main plate side end of the axially extending portion 132*b* and the inner surface of the casing 111.

The radially extending portion 132*c* is an annular portion that extends from the outer peripheral end of the side plate body portion 132*a* further toward the outer peripheral side than the radial-direction outer peripheral end of the axially extending portion 132*b*. Additionally, the radially extending portion 132*c* has a shape where the radial-direction inner peripheral side end surface of the radially extending portion 132*c* is included in the end surface connected to the side plate body portion 132*a* when the impeller 113 is seen from the radial direction.

In this manner, the entire side plate 132 is formed so as to not overlap the other ends of the blades 133 when the impeller 113 is seen from the opposite-main plate side (i.e., from the suction opening 111*a* side).

(2) Operation of Multiblade Fan

Next, operation of the multiblade fan 110 will be described using FIG. 3 and FIG. 4.

When the motor 114 is driven to cause the multiblade fan 110 to run, the impeller 113 rotates inside the casing 111. Thus, the blades 133 of the impeller 113 boost the pressure of and blow out gas from the space on the inner peripheral side to the space on the outer peripheral side, the gas is sucked into the space on the inner peripheral side of the impeller 113 from the suction opening 111*a*, and gas blown out to the outer peripheral side of the impeller 113 is gathered in the blowout opening 111*b* and blown out.

Here, in the multiblade fan 110 of the present embodiment also, similar to the conventional multiblade fan 10, there occur a suction main flow W1 that is a flow that sucks in gas through the suction opening 111*a* from the rotational axis O direction and a swirling flow X1 where some of the gas blown out to the outer peripheral side of the impeller 113 is again sucked into the space on the inner peripheral side of the impeller 113 from between the side plate 132 and the portion of the inner surface of the casing 111 surrounding the suction opening 111*a*.

However, in the multiblade fan 110 of the present embodiment, the axially extending portion 132*b* is disposed on the side plate 132, so as shown in FIG. 4, the swirling flow X1 is sucked into the space on the inner peripheral side of the impeller 113 through the inner surface side of the casing 111 surrounding the suction opening 111*a* more than the swirling flow X (represented by dotted lines in FIG. 4) in the conventional multiblade fan 10, and it is easier for the vector of the flow of the swirling flow X1 to coincide with the vector of the flow of the suction main flow W1. Moreover, in the multiblade fan 110 of the present embodiment, the opposite-main plate side end of the axially extending portion 132*b* extends as far as a position overlapping the impeller-side end of the bellmouth 112 in the rotational axis O direction, so it becomes easier for the vector of the flow of the swirling flow X1 to further coincide with the vector of the flow of the suction main flow W1. In this manner, because the vector of the flow of the swirling flow X1 coincides with the vector of the flow of the suction main flow W1, turbulence in the flow of gas when the swirling flow X1 merges with the suction main flow W1 can be reduced.

Further, in the multiblade fan 110 of the present embodiment, the reverse-direction flow Y (represented by dotted lines in FIG. 4) that had occurred in the conventional multiblade fan 10 is blocked by the radially extending portion 132*c* disposed on the side plate 132 and is changed to a flow along the opposite-main plate side surface of the radially extending portion 132*c*. In this manner, because the reverse-direction flow Y that had occurred in the conventional multiblade fan 10 is blocked by the radially extending portion 132*c* and is changed to a flow along the opposite-main plate side surface of the radially extending portion 132*c*, the occurrence of the reverse-direction flow Y is controlled and the swirling flow X1 can be promoted.

As described above, in the impeller 113 of the multiblade fan 110 of the present embodiment, the axially extending portion 132*b* and the radially extending portion 132*c* are disposed on the side plate 132, so it becomes possible to control the reverse-direction flow and promote a swirling flow coinciding with the vector of the flow of the suction main flow, and it becomes possible to reduce noise and improve blowing performance.

(3) Molding of Impeller of Multiblade Fan

Figure 5:
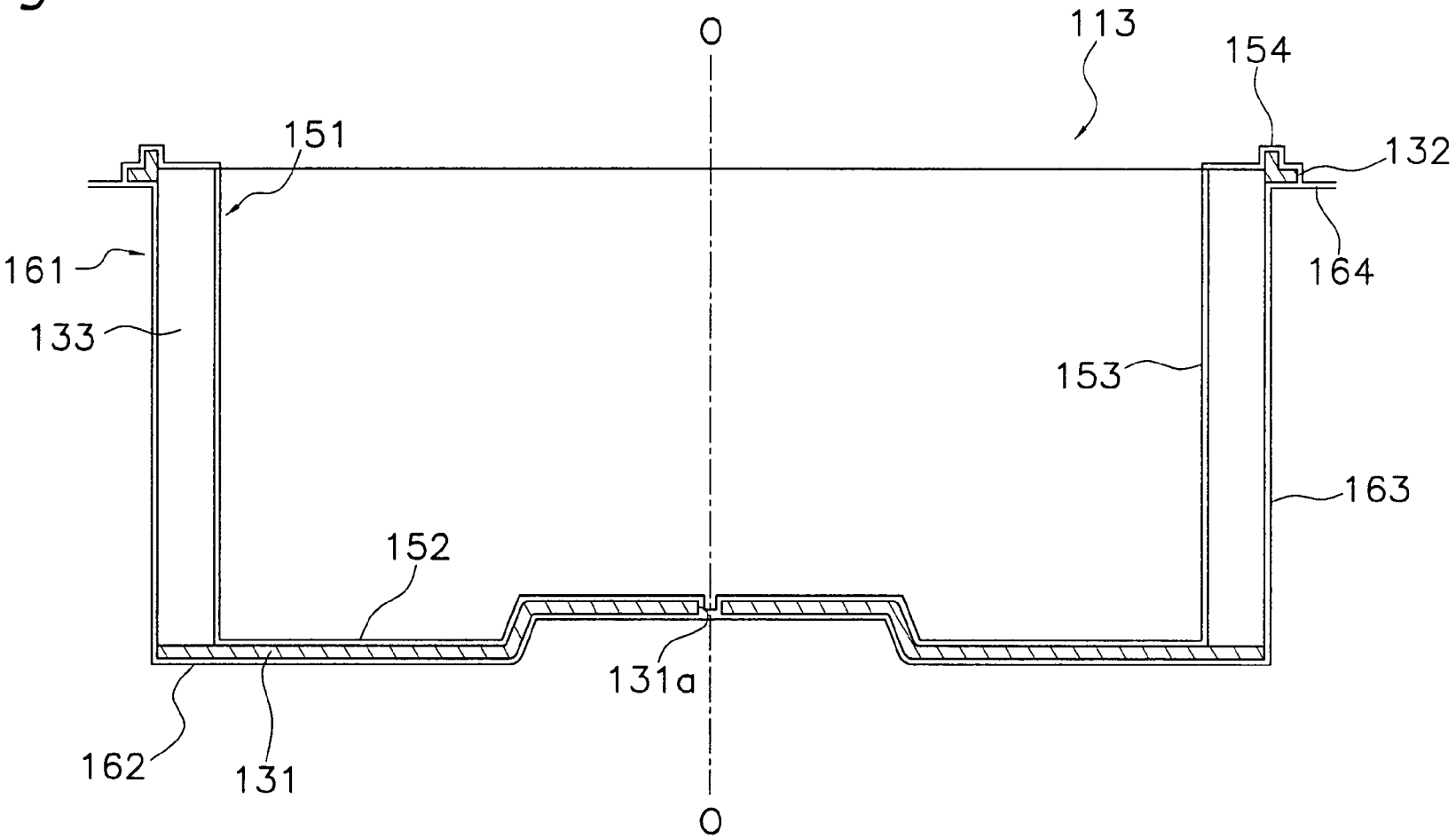
FIG. 5 is a side cross-sectional view of the impeller of the multiblade fan pertaining to the first embodiment and a view showing the shapes of dies of a portion corresponding to this cross-sectional view.
Figure 6:
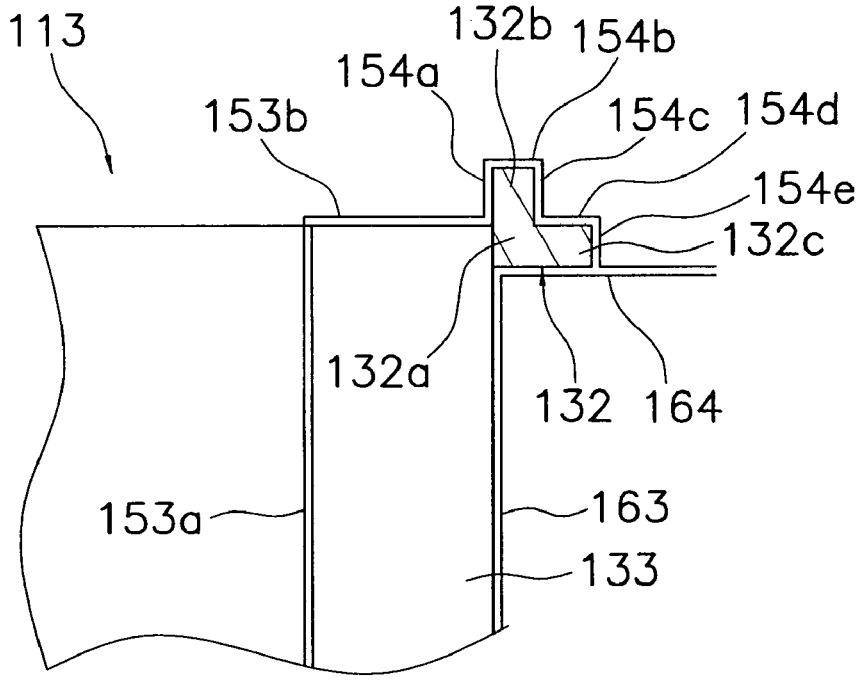
FIG. 6 is an enlarged view of FIG. 5 and a view showing a side plate vicinity of the impeller and the dies.

Next, molding of the impeller 113 of the multiblade fan 110 will be described using FIG. 5 and FIG. 6. Here, FIG. 5 is a side cross-sectional view of the impeller 113 of the multiblade fan 110 and is a view showing the shapes of dies 151 and 161 of a portion corresponding to this cross-sectional view. FIG. 6 is an enlarged view of FIG. 5 and is a view showing the side plate 132 vicinity of the impeller 113 and the dies 151 and 161.

The impeller 113 of the multiblade fan 110 of the present embodiment is shaped by integrally molding resin using a pair of dies 151 and 161.

As shown in FIG. 5 and FIG. 6, when the dies 151 and 161 are aligned in the rotational axis O direction, a main plate forming portion 152 of the die 151 and a main plate forming portion 162 of the die 161 shape the main plate 131 including the center hole 131*a*, a blade forming portion 153 of the die 151 and a blade forming portion 163 of the die 161 shape the blades 133, and a side plate forming portion 154 of the die 151 and a side plate forming portion 164 of the die 161 shape the side plate 132.

More specifically, the rotational-direction front surfaces and the rotational-direction rear surfaces of the blades 133 are formed by a first portion 153*a* of the blade forming portion 153 and by the blade forming portion 163, and the opposite-main plate side end surfaces of the blades 133 are formed by a second portion 153*b* of the blade forming portion 153. Here, each of the blades 133 has a shape where the blade chord length at the other end connected to the side plate 132 is slightly smaller with respect to the blade chord length at the one end connected to the main plate 131, so it is possible to remove the die 151 in the rotational axis O direction.

Further, the radial-direction inner peripheral edge surface of the side plate 132 (i.e., the radial-direction inner peripheral edges of the side plate body portion 132*a* and the axially extending portion 132*b*) is formed by a first portion 154*a* of the side plate forming portion 154, the opposite-main plate side end surface and the radial-direction outer peripheral edge surface of the axially extending portion 132*b* are formed by a second portion 154*b* and a third portion 154*c* of the side plate forming portion 154, the opposite-main plate side end surface and the radial-direction outer peripheral edge surface of the radially extending portion 132*c* are formed by a fourth portion 154*d* and a fifth portion 154*e* of the side plate forming portion 154, and the main-plate side surface of the side plate 132 (i.e., the main-plate side surfaces of the side plate body portion 132*a* and the radially extending portion 132*c*) is formed by the side plate forming portion 164. Here, the entire side plate 132 is formed so as to not overlap the other ends of the blades 133 when the impeller 113 is seen from the opposite-main plate side, the axially extending portion 132*b* has a shape where the opposite-main plate side end surface of the axially extending portion 132*b* is included in the end surface connected to the side plate body portion 132*a* when the impeller 113 is seen from the opposite-main plate side, and the radially extending portion 132*c* has a shape where the radial-direction inner peripheral side end surface of the radially extending portion 132*c* is included in the end surface connected to the side plate body portion 132*a* when the impeller 113 is seen from the radial direction, so it is possible to remove the die 151 in the rotational axis O direction.

In this manner, the impeller 113 of the multiblade fan 110 of the present embodiment is capable of being integrally molded with resin by removing the dies 151 and 161 in the rotational axis O direction.

(4) First Modification

Figure 7:
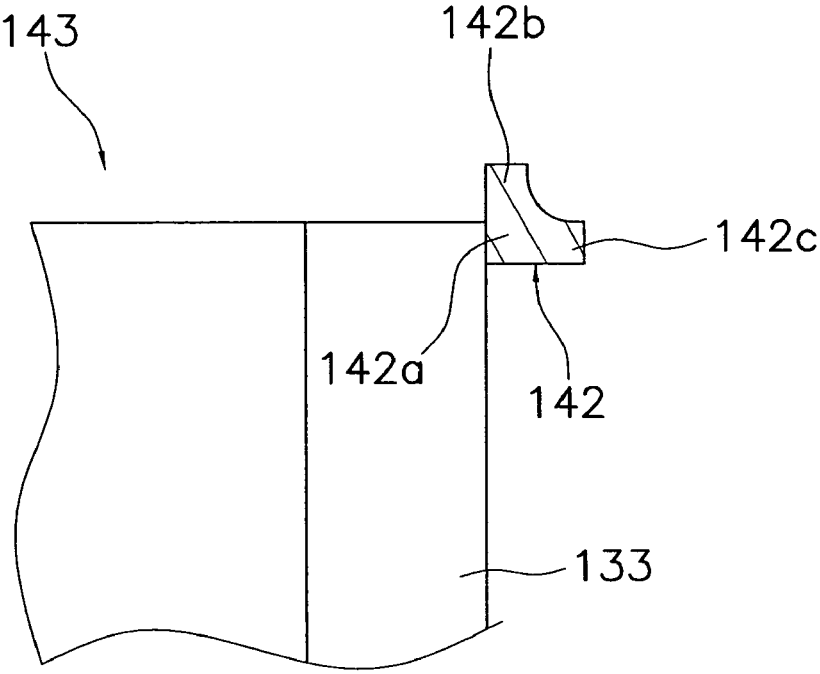
FIG. 7 is a view showing the vicinity of a side plate of an impeller of a multiblade fan pertaining to a first modification of the first embodiment and a view corresponding to FIG. 4.

In the impeller 113 of the above-described multiblade fan 110, the radial-direction outer peripheral edge surface of the axially extending portion 132*b* and the opposite-main plate side surface of the radially extending portion 132*c* of the side plate 132 are connected such that they are substantially orthogonal to each other, but a radial-direction outer peripheral edge surface of an axially extending portion 142*b* and an opposite-main plate side surface of a radially extending portion 142*c* of the side plate 132 may also be smoothly connected as in an impeller 143 shown in FIG. 7. Thus, the swirling flow (see the swirling flow X1 of FIG. 4) flowing from the outer peripheral side to the inner peripheral side of the impeller 143 can be smoothly guided to the opposite-main plate side.

(5) Second Modification

Figure 8:
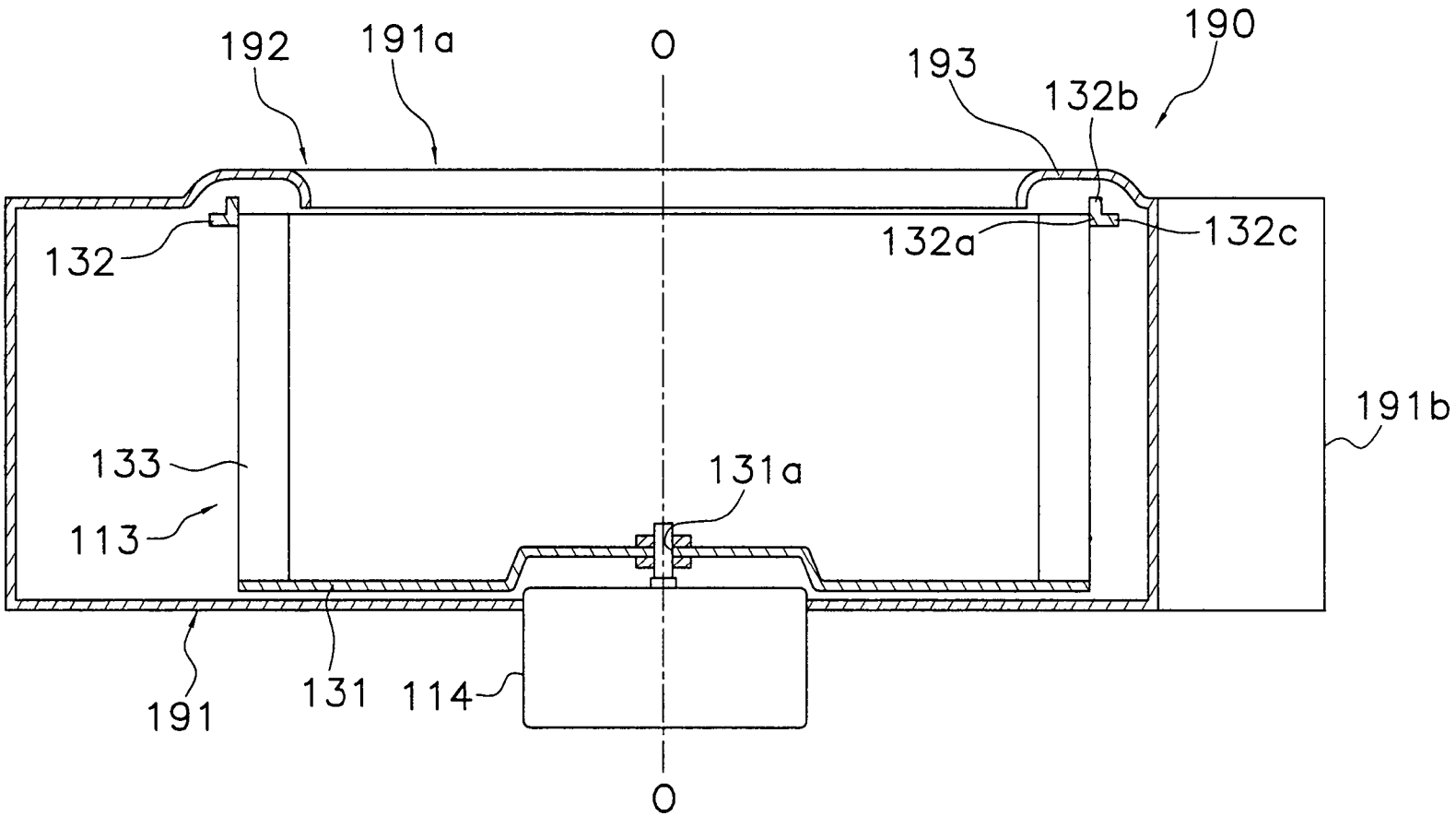
FIG. 8 is a side view of a multiblade fan pertaining to a second modification of the first embodiment.

In the above-described multiblade fan 110, the inner surface of the casing 111 around the suction opening 111*a* is a surface that is substantially orthogonal to the rotational axis O, but an inner surface of a casing 191 around a suction opening 191*a* may include an annular convex portion 193 that protrudes toward the opposite-impeller side, and the opposite-main plate side end of the axially extending portion 132*b* of the impeller 113 may be disposed in correspondence to the convex portion 193 as in the casing 191 shown in FIG. 8. Thus, the swirling flow can be promoted because it becomes possible to allow the swirling flow (see the swirling flow X1 of FIG. 4) to smoothly flow in the space between the inner surface of the casing 191 around the suction opening 191*a* and the axially extending portion 132*b*. Further, the casing 191 of the present modification may be applied to a multiblade fan disposed with the impeller 143 pertaining to the first modification.

Second Embodiment (1) Configuration of Multiblade Fan

Figure 9:
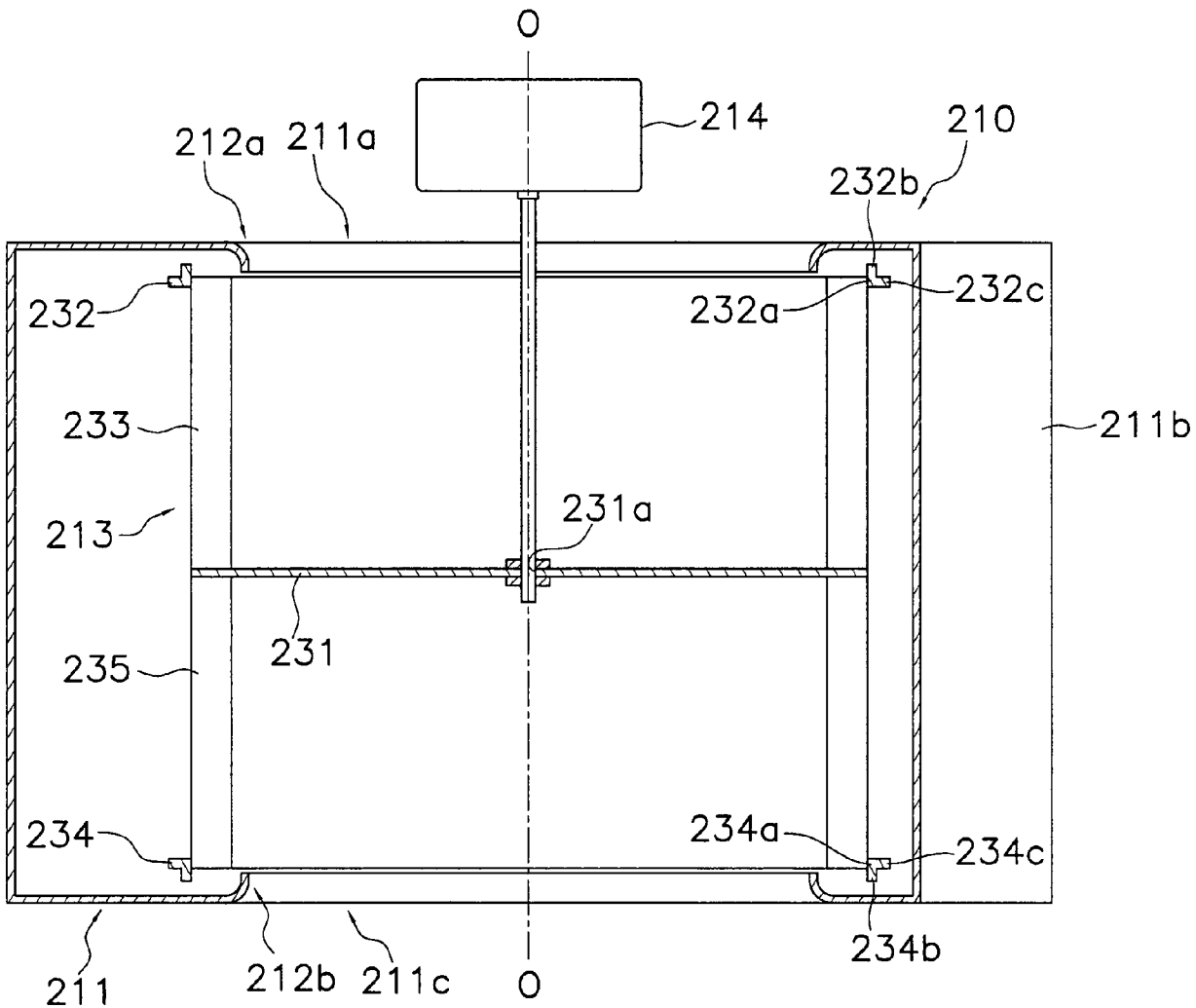
FIG. 9 is a side view of a multiblade fan pertaining to a second embodiment of the present invention.

FIG. 9 shows a multiblade fan 210 pertaining to a second embodiment of the present invention. Here, FIG. 9 shows a side view of the multiblade fan 210 pertaining to the second embodiment of the present invention.

The multiblade fan 210 is an example where the present invention is applied to a double suction type multiblade fan and is configured by an impeller 213, a casing 211 that houses the impeller 213, a motor 214 for driving the impeller 213 to rotate, and the like. Here, O-O in FIG. 9 is the axial line of rotation of the impeller 213 and the motor 214.

Similar to the conventional multiblade fan 10, the casing 211 is a casing with a scroll shape when seen in plan view (see FIG. 2), but in contrast to the single suction type multiblade fan 110, it includes suction openings 211*a* and 211*c* that suck in gas from both sides in the rotational axis O direction and a blowout opening 211*b* that blows out gas in a direction intersecting the rotational axis O. The suction openings 211*a* and 211*c* are disposed so as to face side plates 232 and 234 (described later) of the impeller 213. The peripheries of the suction openings 211*a* and 211*c* are surrounded by bellmouths 212*a* and 212*b* that lead to the impeller 213. The bellmouths 212*a* and 212*b* are portions that are curved in bell shapes toward the impeller 213 at the inner peripheral edge portions of the suction openings 211*a* and 211*c*.

In contrast to the impeller 113 of the single suction type multiblade fan 110, in the impeller 213, one end of each of numerous blades 233 is fixed to an outer peripheral portion of the surface of a main plate 231 at the suction opening 211*a* side, outer peripheral edges of the other ends of the blades 233 are connected to each other by an annular side plate 232 disposed so as to face the suction opening 211*a*, one end of each of numerous blades 235 is fixed to an outer peripheral portion of the surface of the main plate 231 at the suction opening 211*c* side, and outer peripheral edges of the other ends of the blades 235 are connected to each other by an annular side plate 234 disposed so as to face the suction opening 211*c*. That is, the impeller 213 has a structure where one end of each of the numerous blades 233 and 235 is fixed to the outer peripheral portions of both sides of the discoid main plate 231 and where outer peripheral edges of the other ends of the blades 233 and 235 are connected to each other by the annular side plates 232 and 234. Further, as described later, the impeller 213 is a resin product that is integrally molded using dies.

The main plate 231 is a discoid portion and, as shown in FIG. 9, a center hole 231*a* is formed therein. A shaft of the motor 214 is coupled to the center hole 231*a*.

The blades 233 are the same as the blades 133 of the impeller 113 of the first embodiment and are the same as the content whose reference numerals have been changed in the description of the blades 133 of the first embodiment, so description thereof will be omitted here. In regard also to the blades 235, description thereof will be omitted in the same manner as the blades 233.

Similar to the side plate 132 of the impeller 113 of the first embodiment, the side plate 232 includes an annular side plate body portion 232*a*, an axially extending portion 232*b*, and a radially extending portion 232*c*, and because it is the same as the content whose reference numerals have been changed in the description of the side plate 132 of the first embodiment, description thereof will be omitted here. In regard also to the side plate 235, similar to the side plate 232, the side plate 235 includes an annular side plate body portion 235*a*, an axially extending portion 235*b*, and a radially extending portion 235*c*, and description thereof will be omitted in the same manner as the side plate 232.

(2) Operation of Multiblade Fan

Next, operation of the multiblade fan 210 will be described using FIG. 9.

When the motor 214 is driven to cause the multiblade fan 210 to run, the impeller 213 rotates inside the casing 211. Thus, the blades 233 and 235 of the impeller 213 boost the pressure of and blow out gas from the space on the inner peripheral side to the space on the outer peripheral side, the gas is sucked into the space on the inner peripheral side of the impeller 213 from the two suction openings 211*a* and 211*c*, and gas blown out to the outer peripheral side of the impeller 213 is gathered in the blowout opening 211*b* and blown out.

Here, in the multiblade fan 210 of the present embodiment also, similar to the multiblade fan 110 of the first embodiment, the axially extending portions 232*b* and 234*b* are disposed on the side plates 232 and 234, and the opposite-main plate side ends of the axially extending portions 232*b* and 234*b* extend as far as positions overlapping the impeller-side ends of the bellmouths 212*a* and 212*b* in the rotational axis O direction, so it becomes easier for the vector of the flow of the swirling flow (see the swirling flow X1 of FIG. 4) to coincide with the vector of the flow of the suction main flow (see the suction main flow W1 of FIG. 4). In this manner, because the vector of the flow of the swirling flow coincides with the vector of the flow of the suction main flow, turbulence in the flow of gas when the swirling flow merges with the suction main flow can be reduced.

Further, in the multiblade fan 210 of the present embodiment, similar to the multiblade fan 110 of the first embodiment, the reverse-direction flow Y (represented by dotted lines in FIG. 4) is blocked by the radially extending portions 232*c* and 234*c* disposed on the side plates 232 and 234 and is changed to a flow along the opposite-main plate side surfaces of the radially extending portions 232*c* and 234*c*, so the occurrence of the reverse-direction flow is controlled and the swirling flow can be promoted.

As described above, in the impeller 213 of the multiblade fan 210 of the present embodiment also, the axially extending portions 232*b* and 234*b* and the radially extending portions 232*c* and 234*c* are disposed on the side plates 232 and 234, so it becomes possible to control the reverse-direction flow and promote a swirling flow coinciding with the vector of the flow of the suction main flow, and it becomes possible to reduce noise and improve blowing performance.

(3) Molding of Impeller of Multiblade Fan

Figure 10:
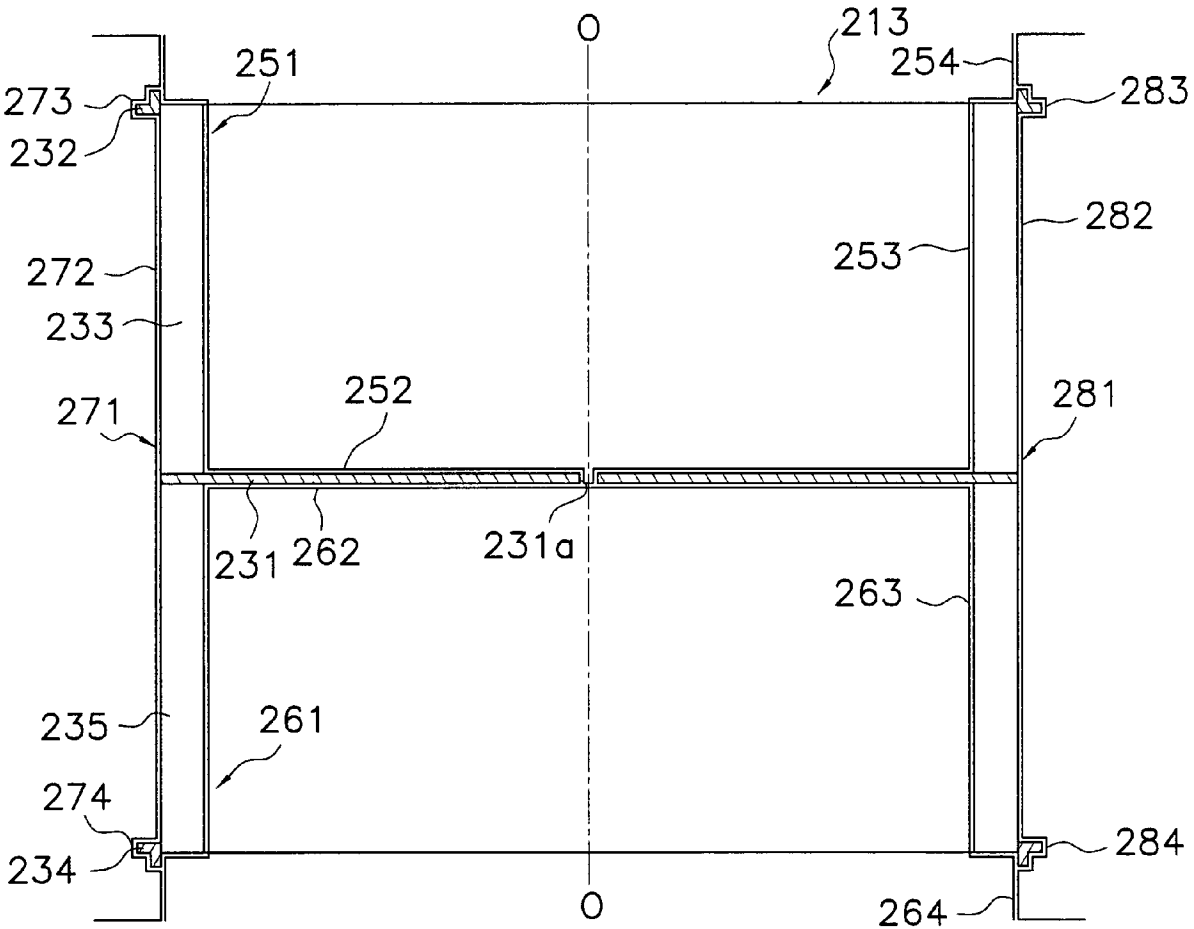
FIG. 10 is a side cross-sectional view of an impeller of the multiblade fan pertaining to the second embodiment and a view showing the shapes of dies of a portion corresponding to this cross-sectional view.
Figure 11:
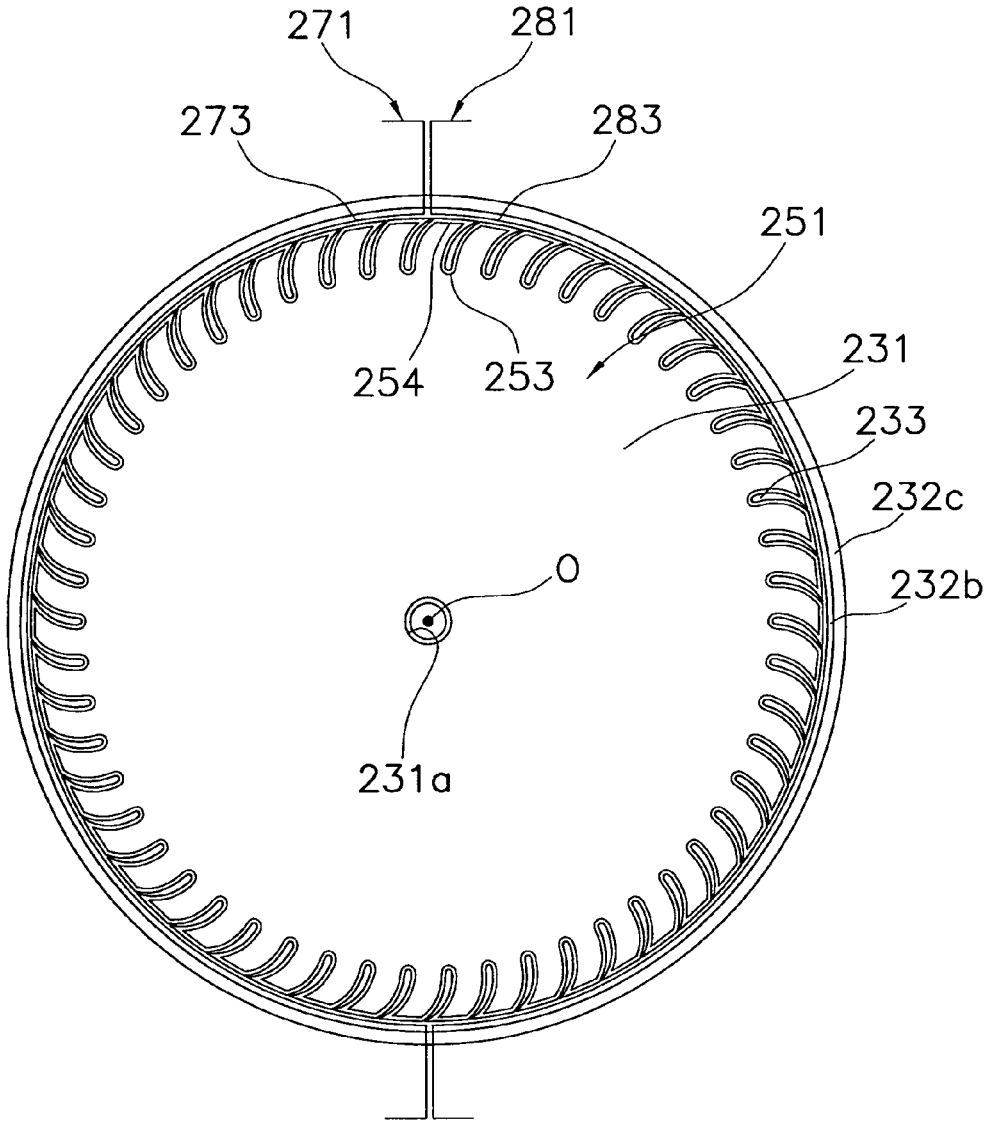
FIG. 11 is a plan view of the impeller of the multiblade fan pertaining to the second embodiment and a view showing the shapes of dies of a portion corresponding to this plan view.
Figure 12:
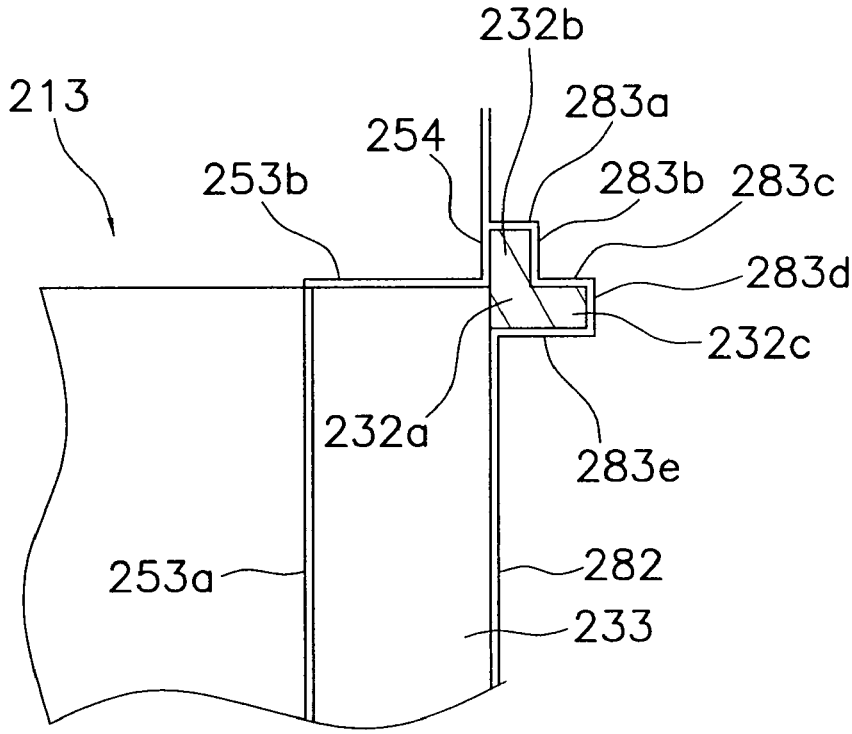
FIG. 12 is an enlarged view of FIG. 10 and a view showing a side plate vicinity of the impeller and the dies.

Next, molding of the impeller 213 of the multiblade fan 210 of the present embodiment will be described using FIG. 10, FIG. 11, and FIG. 12. Here, FIG. 10 is a side cross-sectional view of the impeller 213 of the multiblade fan 210 and is a view showing the shapes of dies 251, 261, 271, and 281 of a portion corresponding to this cross-sectional view. FIG. 11 is a plan view of the impeller 213 of the multiblade fan 210 and is a view showing the shapes of the dies 251, 271, and 281 of the portion corresponding to this plan view. FIG. 12 is an enlarged view of FIG. 10 and is a view showing the side plate 232 vicinity of the impeller 213 and the dies 251, 261, and 281.

The impeller 213 of the multiblade fan 210 of the present embodiment is shaped by integrally molding resin using two pairs of dies 251 and 261 and dies 271 and 281.

As shown in FIG. 10, FIG. 11, and FIG. 12, when the dies 251 and 261 are aligned in the rotational axis O direction, a main plate forming portion 252 of the die 251 and a main plate forming portion 262 of the die 261 shape the main plate 231 (excluding the radial-direction outer peripheral edge) including the center hole 231*a*, a blade forming portion 253 of the die 251 shapes the blades 233 (excluding the radial-direction outer peripheral edges), a blade forming portion 263 of the die 261 shapes the blades 235 (excluding the radial-direction outer peripheral edges), a side plate forming portion 254 of the die 251 shapes the radial-direction inner peripheral edge surface of the side plate 232 (i.e., the radial-direction inner peripheral edges of the side plate body portion 232*a* and the axially extending portion 232*b*), and a side plate forming portion 264 of the die 261 shapes the radial-direction inner peripheral edge surface of the side plate 234 (i.e., the radial-direction inner peripheral edges of the side plate body portion 234*a* and the axially extending portion 234*b*).

More specifically, in regard to the blades 233, the rotational-direction front surfaces and the rotational-direction rear surfaces of the blades 233 are formed by a first portion 253*a* of the blade forming portion 253 and by the blade forming portion 263, and the opposite-main plate side end surfaces of the blades 233 are formed by a second portion 253*b* of the blade forming portion 253. Here, each of the blades 233 has a shape where the blade chord length at the other end connected to the side plate 232 is slightly smaller with respect to the blade chord length at the one end connected to the main plate 231, so it is possible to remove the die 251 in the rotational axis O direction. Further, in regard to the blades 235, the rotational-direction front surfaces and the rotational-direction rear surfaces of the blades 235 are formed by a first portion and a blade forming portion (not shown) formed in the blade forming portion 263 of the die 261.

Further, as shown in FIG. 10, FIG. 11, and FIG. 12, when the dies 271 and 281 are aligned in the direction orthogonal to the rotational axis O direction (i.e., the radial direction), outer peripheral edge forming portions 272 and 282 shape the radial-direction outer peripheral edge of the main plate 231 and the radial-direction outer peripheral edges of the blades 233 and 235, and side plate forming portions 273 and 283 shape the side plates 232 and 234 (excluding the radial-direction inner peripheral edge surfaces of the side plates 232 and 234).

More specifically, in regard to the portion of the side plate 232 at the die 281 side, the opposite-main plate side end surface and the radial-direction outer peripheral edge surface of the axially extending portion 232*b* are formed by a first portion 283*a* and a second portion 283*b* of the side plate forming portion 283, the opposite-main plate side end surface and the radial-direction outer peripheral edge surface of the radially extending portion 232*c* are formed by a third portion 283*c* and a fourth portion 283*d* of the side plate forming portion 283, and the main plate side surface of the side plate 232 (i.e., the main plate side surfaces of the side plate body portion 232*a* and the radially extending portion 232*c*) is formed by a fifth portion 283*e* of the side plate forming portion 283. Further, similar to the side plate forming portion 283, the portion of the side plate 232 at the die 271 side is also formed by first to fifth portions (not shown) formed on the side plate forming portion 273 of the die 271. Moreover, the side plate 234 is also formed by first to fifth portions (not shown) formed on the side plate forming portion 274 of the die 271 and by first to fifth portions (not shown) formed on the side plate forming portion 284 of the die 281. Here, the entireties of the side plates 232 and 234 are formed so as to not overlap the other ends of the blades 233 and 235 when the impeller 213 is seen from the opposite-main plate side, the axially extending portions 232*b* and 234*b* have shapes where the opposite-main plate side end surfaces of the axially extending portions 232*b* and 234*b* are included in the end surfaces connected to the side plate body portions 232*a* and 234*a* when the impeller 213 is seen from the opposite-main plate side, and the radially extending portions 232*c* and 234*c* have shapes where the radial-direction inner peripheral side end surfaces of the radially extending portions 232*c* and 234*c* are included in the end surfaces connected to the side plate body portions 232*a* and 234*a* when the impeller 213 is seen from the radial direction, so it is possible for the dies 271 and 281 to be removed in the radial direction.

In this manner, the impeller 213 of the multiblade fan 210 of the present embodiment is capable of being integrally molded with resin by removing the dies 251 and 261 in the rotational axis O direction and by removing the dies 271 and 281 in the radial direction.

(4) First Modification

Figure 13:
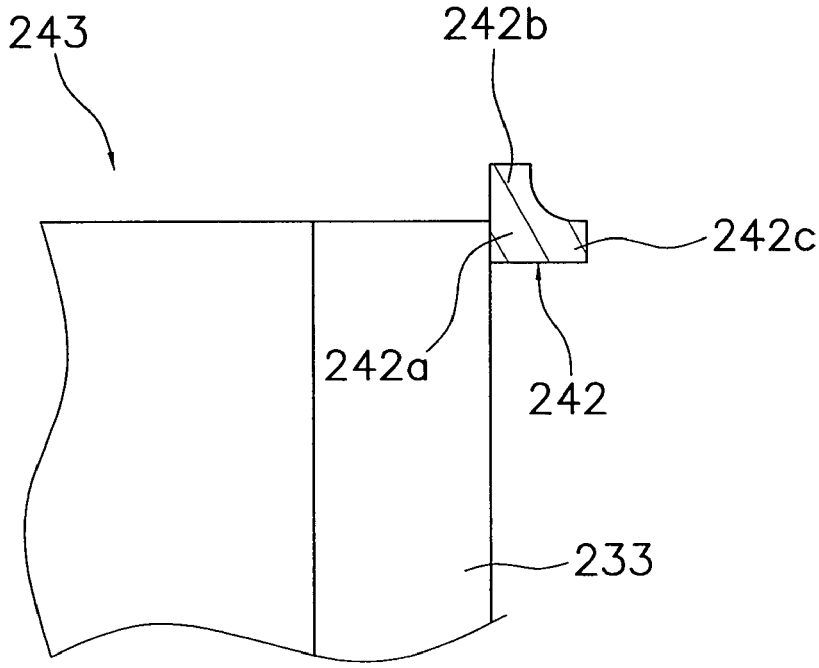
FIG. 13 is a view showing the vicinity of a side plate of an impeller of a multiblade fan pertaining to a first modification of the second embodiment and a view corresponding to FIG. 4.

In the impeller 213 of the above-described multiblade fan 210, the radial-direction outer peripheral edge surfaces of the axially extending portions 232*b* and 234*b* and the opposite-main plate side surfaces of the radially extending portions 232*c* and 234*c* of the side plates 232 and 234 are connected such that they are substantially orthogonal to each other, but radial-direction outer peripheral edge surfaces of axially extending portions 242*b* and 244*b* and opposite-main plate side surfaces of radially extending portions 242*c* and 244*c* of side plates 232 and 234 may also be smoothly connected as in an impeller 243 shown in FIG. 13. Thus, the swirling flow (see the swirling flow X1 of FIG. 4) flowing from the outer peripheral side to the inner peripheral side of the impeller 243 can be smoothly guided to the opposite-main plate side.

(5) Second Modification

Figure 14:
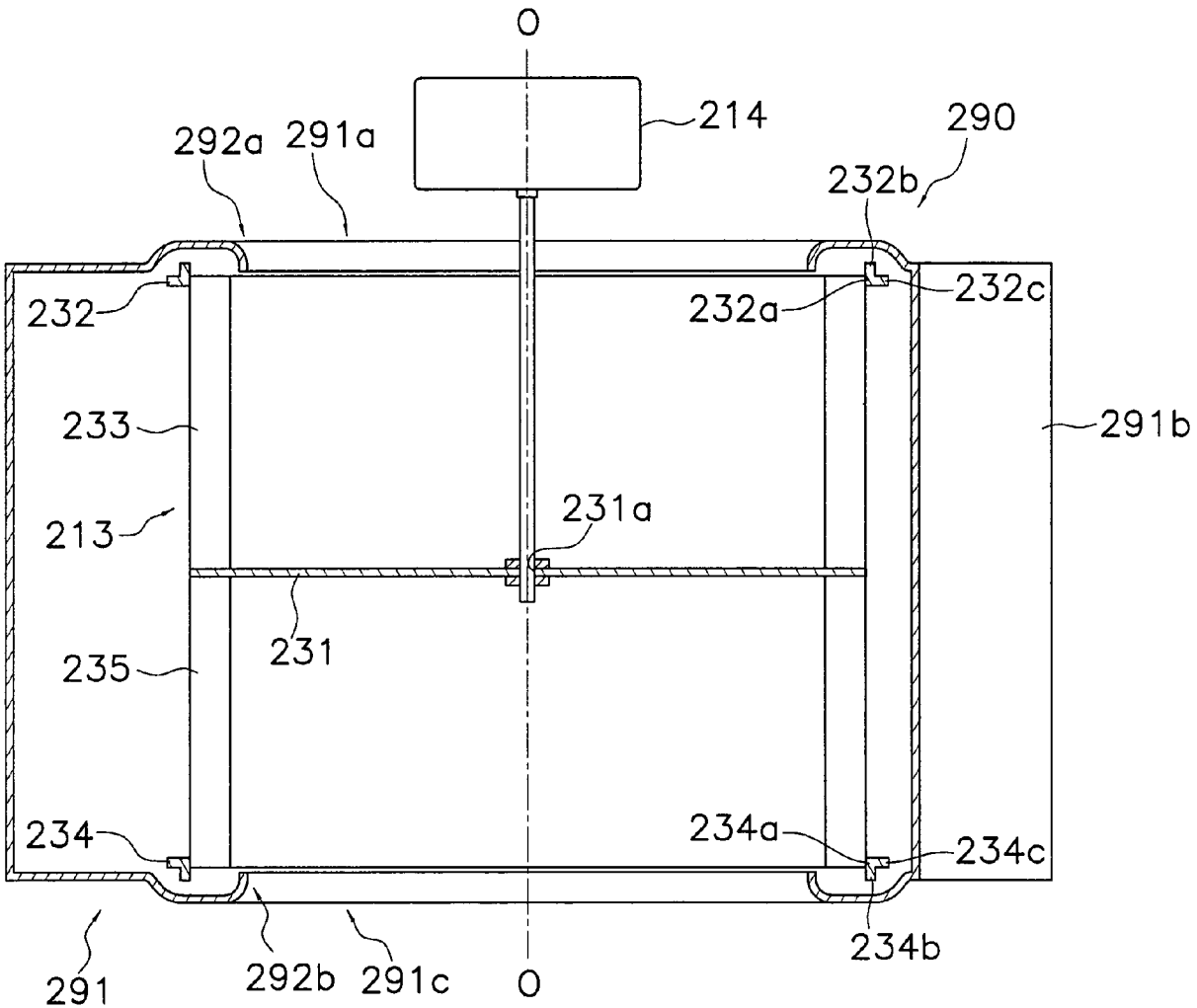
FIG. 14 is a side view of a multiblade fan pertaining to a second modification of the second embodiment.

In the above-described multiblade fan 210, the inner surface of the casing 211 around the suction openings 211*a* and 211*c* is a surface that is substantially orthogonal to the rotational axis O, but an inner surface of a casing 291 around suction openings 291*a* and 291*c* may include annular convex portions 293 and 294 that protrude toward the opposite-impeller side, and the opposite-main plate side ends of the axially extending portions 232*b* and 234*b* of the impeller 213 may be disposed in correspondence to the convex portions 293 and 294 as in the casing 291 shown in FIG. 14. Thus, the swirling flow can be promoted because it becomes possible to allow the swirling flow (see the swirling flow X1 of FIG. 4) to smoothly flow in the spaces between the inner surface of the casing 291 around the suction openings 291*a* and 291*c* and the axially extending portions 232*b* and 234*b*. Further, the casing 291 of the present modification may be applied to a multiblade fan disposed with the impeller 243 pertaining to the first modification.

INDUSTRIAL APPLICABILITY

By utilizing the present invention, an impeller of a multiblade fan capable of reducing noise and improving blowing performance and a multiblade fan having the impeller can be provided.

What is claimed is:

1. A multiblade fan comprising:

an impeller having a discoid main plate configured to rotate about a rotational axis, a plurality of blades disposed annularly about the rotational axis on one side or both sides of the main plate, with one end of each of the blades being fixed to an outer peripheral portion of the main plate, and one or two side plates including an annular side plate body portion that joins outer peripheral edges of the other ends of the blades to each other, an axially extending portion that extends from an opposite-main plate side end of the side plate body portion in the rotational axis direction further than opposite-main plate side ends of the blades, and a radially extending portion that extends from an outer peripheral end of the side plate body portion further than a radial-direction outer peripheral end of the axially extending portion, the one or two side plates being attached to radially outermost surfaces of the blades which form the outer peripheral edges of the other ends of the blades such that the one or two side plates are disposed radially outward of the radially outermost edges of the blades;

a drive mechanism configured to drive the main plate to rotate; and a casing including one or two suction openings formed facing the side plate such that the suction opening can suck in gas from the rotational axis direction and a blowout opening that blows out gas in a direction intersecting the rotational axis, an inner surface of the casing around the suction opening including a first annular concave section facing the main plate and facing radially outwardly and a second annular concave section facing the main plate and facing radially inwardly such that the second annular concave section is radially opposed to the first annular concave section, the axially extending portion of the side plate being disposed radially closer to the second annular concave section than the first annular concave section, with the opposite-main plate side end of the axially extending portion being disposed radially between the first and second annular concave sections, and a radial direction outer peripheral end of the radially extending portion being disposed so as not to protrude radially outwardly beyond a radial direction outer peripheral end of the second annular concave section toward an outer peripheral side when seen from the rotational axis direction.

2. The multiblade fan of claim 1, wherein the side plate is formed so as to not overlap the blades when seen from the opposite-main plate side end.

3. The multiblade fan of claim 1, wherein the axially extending portion of the side plate is spaced radially outward of the first annular concave section of the inner surface of the casing.

4. The multiblade fan of claim 1, wherein the inner surface of the casing further includes a flat section extending radially between the first and second annular concave sections, with a radially innermost end of the radially extending portion being aligned with the flat section when viewed along the rotational axis direction.

5. The multiblade fan of claim 4, wherein the axially extending portion of the side plate is entirely aligned with the flat section when viewed along the rotational axis direction.

6. The multiblade fan of claim 5, wherein the axially extending portion of the side plate is spaced radially outward of the first annular concave section of the inner surface of the casing.

7. The multiblade fan of claim 4, wherein the flat section of the inner surface of the casing is contiguously connected to the first annular concave section of the inner surface of the casing.

8. The multiblade fan of claim 7, wherein the axially extending portion of the side plate is entirely aligned with the flat section when viewed along the rotational axis direction.

9. The multiblade fan of claim 8, wherein the axially extending portion of the side plate is spaced radially outward of the first annular concave section of the inner surface of the casing.

10. The multiblade fan of claim 7, wherein the flat section of the inner surface of the casing is contiguously connected to the second annular concave section of the inner surface of the casing.

11. The multiblade fan of claim 10, wherein the axially extending portion of the side plate is entirely aligned with the flat section when viewed along the rotational axis direction.

12. The multiblade fan of claim 11, wherein the axially extending portion of the side plate is spaced radially outward of the first annular concave section of the inner surface of the casing.

13. The multiblade fan of claim 1, wherein the inner surface of the casing further includes a flat section extending radially between the first and second annular concave sections, with the flat section of the inner surface of the casing contiguously connected to the first annular concave section of the inner surface of the casing.

14. The multiblade fan of claim 13, wherein the flat section of the inner surface of the casing is contiguously connected to the second annular concave section of the inner surface of the casing.

15. The multiblade fan of claim 1, wherein the radially extending portion of the side plate has flat ring-shape that extends radially outward from the outer peripheral end of the side plate body portion such that radial direction inner and outer peripheral ends thereof are disposed at a common axial position.

16. The multiblade fan of claim 15, wherein the axially extending portion of the side plate has a cylindrical shape that extends axially from the opposite-main plate side end of the side plate body portion such that axial direction inner and outer peripheral ends thereof are disposed at a common radial position.

17. The multiblade fan of claim 1, wherein the side plate body portion is axially aligned with the radial direction outer peripheral end of the radially extending portion of the side plate.

18. The multiblade fan of claim 17, wherein the side plate body portion is radially aligned with an axial direction outer peripheral end of the axially extending portion of the side plate.

19. The multiblade fan of claim 1, wherein the side plate body portion is radially aligned with an axial direction outer peripheral end of the axially extending portion of the side plate.

* * * * *